US008958594B2

(12) United States Patent
Yoshida

(10) Patent No.: US 8,958,594 B2
(45) Date of Patent: Feb. 17, 2015

(54) SPEAKER DEVICE

(75) Inventor: Kazuyoshi Yoshida, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/978,295

(22) PCT Filed: Apr. 13, 2012

(86) PCT No.: PCT/JP2012/002574

§ 371 (c)(1),
(2), (4) Date: Jul. 3, 2013

(87) PCT Pub. No.: WO2013/014829

PCT Pub. Date: Jan. 31, 2013

(65) Prior Publication Data

US 2013/0272782 A1 Oct. 17, 2013

(30) Foreign Application Priority Data

Jul. 25, 2011 (JP) ..... 2011-162455

(51) Int. Cl.
*H04R 1/02* (2006.01)
*H04R 5/02* (2006.01)

(52) U.S. Cl.
CPC .. *H04R 1/02* (2013.01); *H04R 5/02* (2013.01); *H04R 2201/025* (2013.01)
USPC ..... 381/386; 381/388; 103/292

(58) Field of Classification Search
CPC .. H05K 5/0021; H04R 1/02; H04R 2201/025; H04R 5/02
USPC ..... 403/292, 296; 29/525.01, 505; 181/144, 181/196
See application file for complete search history.

(56) References Cited

U.S. PATENT DOCUMENTS

| | | | |
|---|---|---|---|
| 2004/0264716 | A1 | 12/2004 | Fidlin et al. |
| 2008/0080720 | A1 | 4/2008 | Jacob et al. |
| 2010/0008522 | A1 | 1/2010 | Sumitani et al. |
| 2010/0254557 | A1 | 10/2010 | Cho et al. |

FOREIGN PATENT DOCUMENTS

| | | | |
|---|---|---|---|
| JP | 58-191780 | | 12/1983 |
| JP | 02-126793 | | 5/1990 |
| JP | 02126793 A | * | 5/1990 |
| JP | 4-114241 | | 10/1992 |
| JP | 2005-27307 | | 1/2005 |
| JP | 2007-104393 | | 4/2007 |

OTHER PUBLICATIONS

International Search Report mailed May 15, 2012 in International (PCT) Application No. PCT/JP2012/002574.
International Preliminary Report on Patentability issued Jan. 29, 2013 in International (PCT) Application No. PCT/JP2012/002574 with partial translation.
Extended European Search Report issued Dec. 10, 2014 in corresponding European Patent Application No. 12816981.0.

* cited by examiner

*Primary Examiner* — Quoc D Tran
*Assistant Examiner* — Sunita Joshi
(74) *Attorney, Agent, or Firm* — Wenderoth, Lind & Ponack, L.L.P.

(57) ABSTRACT

A speaker device includes: a first speaker unit (10) provided with a groove part (11); a second speaker unit (20) provided with a groove part (21); and a joining component (30) including a first protrusion (31) and a second protrusion (32). The first protrusion (31) of the joining component (30) is fitted into the groove part (11) of the first speaker unit (10). The second protrusion (32) of the joining component (30) is fitted into the groove part (21) of the second speaker unit (20).

2 Claims, 10 Drawing Sheets

SPEAKER DEVICE

TECHNICAL FIELD

The present invention relates to speaker devices, and more specifically, to bar-type speaker devices including two speaker units capable of being joined together or separated from each other.

BACKGROUND ART

Conventionally, speaker devices which reproduce sound generated from a video processing apparatus such as a thin-screen television are generally built in the housing of the thin-screen television along with its display. However, in recent years, associated with a trend of thin-screen televisions with larger screens and wall-mount type thin-screen televisions, there are demands for production of thin-screen televisions having a structure in which a display and a speaker device are independent of each other.

In the case of a product having a structure in which the display and the speaker device are independent of each other, in order to allow a user to change the use form of the speaker device (mounted on the wall, standing on the floor, separately arranged left and right of the display, integrally mounted to the lower part of the display (bar-type), and the like) in accordance with the viewing style of the user, a structure is desirable that facilitates the user's joining or separating work of two speaker units (e.g., a speaker unit for the right channel and a speaker unit for the left channel in the case of a two-channel stereo).

As a structure that allows join and separation of two speaker units, there is a structure of a conventional speaker device disclosed in Patent Literature 1, for example. In the structure of the conventional speaker device, two speaker boxes are sandwiched by two metal plates, and the speaker boxes and the metal plates are fixed with bolts and nuts.

CITATION LIST

Patent Literature

[PTL 1] Japanese Laid-Open Patent Publication No. H2-126793

SUMMARY OF THE INVENTION

Problems to be Solved by the Invention

However, in the case of the conventional speaker device described above, when trying to freely customize the configuration of the speaker device, work for joining the two speaker units is too troublesome.

Further, in the conventional speaker device described above, fixing the speaker boxes with bolts and nuts is performed by the user. Thus, when the tightening levels of bolts and nuts vary, the speaker boxes may tilt or be displaced. Therefore, the user has to perform the joining work many times in order to obtain a satisfactory level of integrity.

Therefore, an object of the present invention is to provide a bar-type speaker device including two speaker units capable of being joined together or separated from each other, the speaker device not requiring troublesome joining work and allowing the user to obtain a satisfactory level of integrity through a single joining operation.

Solutions to the Problems

The present invention is directed to a bar-type speaker device including two speaker units capable of being joined together or separated from each other. In order to achieve the above object, the speaker device of the present invention includes: a first and second speaker units each provided with a groove part; and a joining component including two protrusions and configured to join the first speaker unit and the second speaker unit into a bar shape by respectively fitting the two protrusions into the groove parts.

Preferably, each of the first and second speaker units includes a spring part configured to press and fix the fitted protrusion. Further, the protrusion is provided with a screw hole, and the spring part is provided with a screw hole having a rib configured to be hooked in the screw hole of the protrusion when the protrusion is fitted into the groove part. Preferably, each of the screw hole of the protrusion and the rib of the screw hole of the spring part is provided with a taper having an identical gradient. Still preferably, the bar-type speaker device has a structure in which, through screwing, the taper of the rib of the screw hole of the spring part is brought into contact with the taper of the screw hole of the protrusion with a pressure applied thereon, to bring the first and second speaker units and the joining component into close contact with each other.

Further, if a second joining component including, on a base, a protrusion having a shape identical to that of the two protrusions is prepared, and the bar-type speaker device is made capable of being changed into a standing-type speaker device by fitting the groove part of the first or second speaker unit onto the protrusion of the second joining component, the convenience for the user is further improved.

Advantageous Effects of the Invention

According to the present invention, click feeling can be generated when the joining component is fitted into a speaker unit, and also, the gap between the joining component and the speaker unit can be reduced through screwing. Accordingly, the present invention can exhibit a special effect that troublesome joining work is not required, and that a satisfactory level of integrity can be obtained through a single joining operation.

DESCRIPTION OF EMBODIMENTS

Figure 1A:
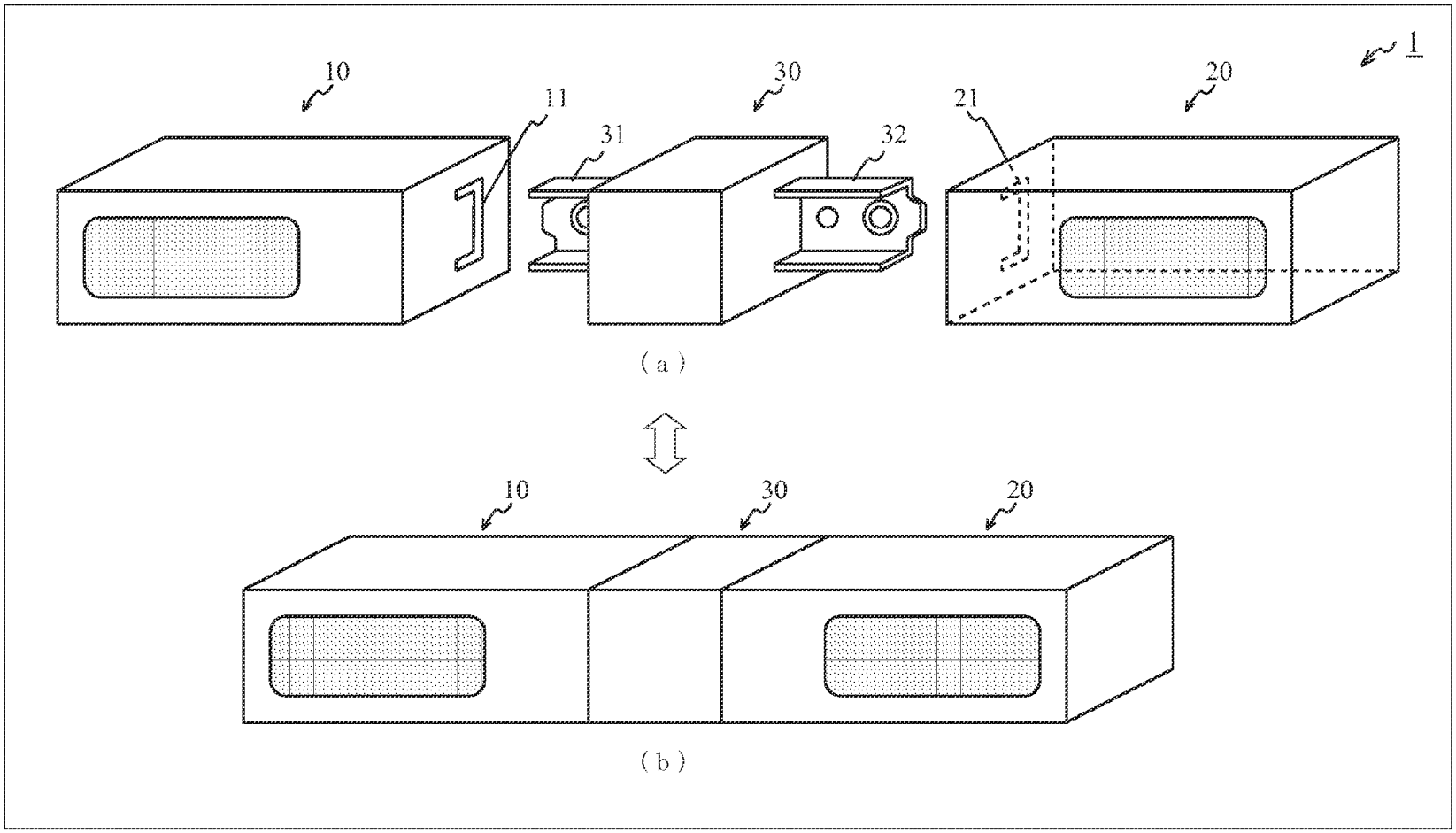
FIG. 1A shows a configuration of a bar-type speaker device 1 according to one embodiment of the present invention.

FIG. 1A shows a configuration of a bar-type speaker device 1 according to one embodiment of the present invention. The speaker device 1 according to the present embodiment shown in FIG. 1A includes a first speaker unit 10, a second speaker unit 20, and a joining component 30. The first speaker unit 10 and the second speaker unit 20 of the present embodiment have an identical structure. Thus, for example, when using the speaker device 1 of the present invention for reproducing two-channel stereo sound, either of the speaker units can be used for either of the left and right channels.

As shown in (a) of FIG. 1A, the joining component 30 includes a first protrusion 31 and a second protrusion 32. The first speaker unit 10 is provided with a groove part 11 having a shape that allows the first protrusion 31 (or the second protrusion 32) to be fitted into the groove part 11. The second speaker unit 20 includes a groove part 21 having a shape that allows the second protrusion 32 (or the first protrusion 31) to be fitted into the groove part 21. By fitting the first and second protrusions 31 and 32 of the joining component 30 into the groove parts 11 and 21 of the first and second speaker units 10 and 20, respectively, a bar-shaped speaker device (speaker bar) shown in (b) of FIG. 1A can be formed.

Figure 1B:
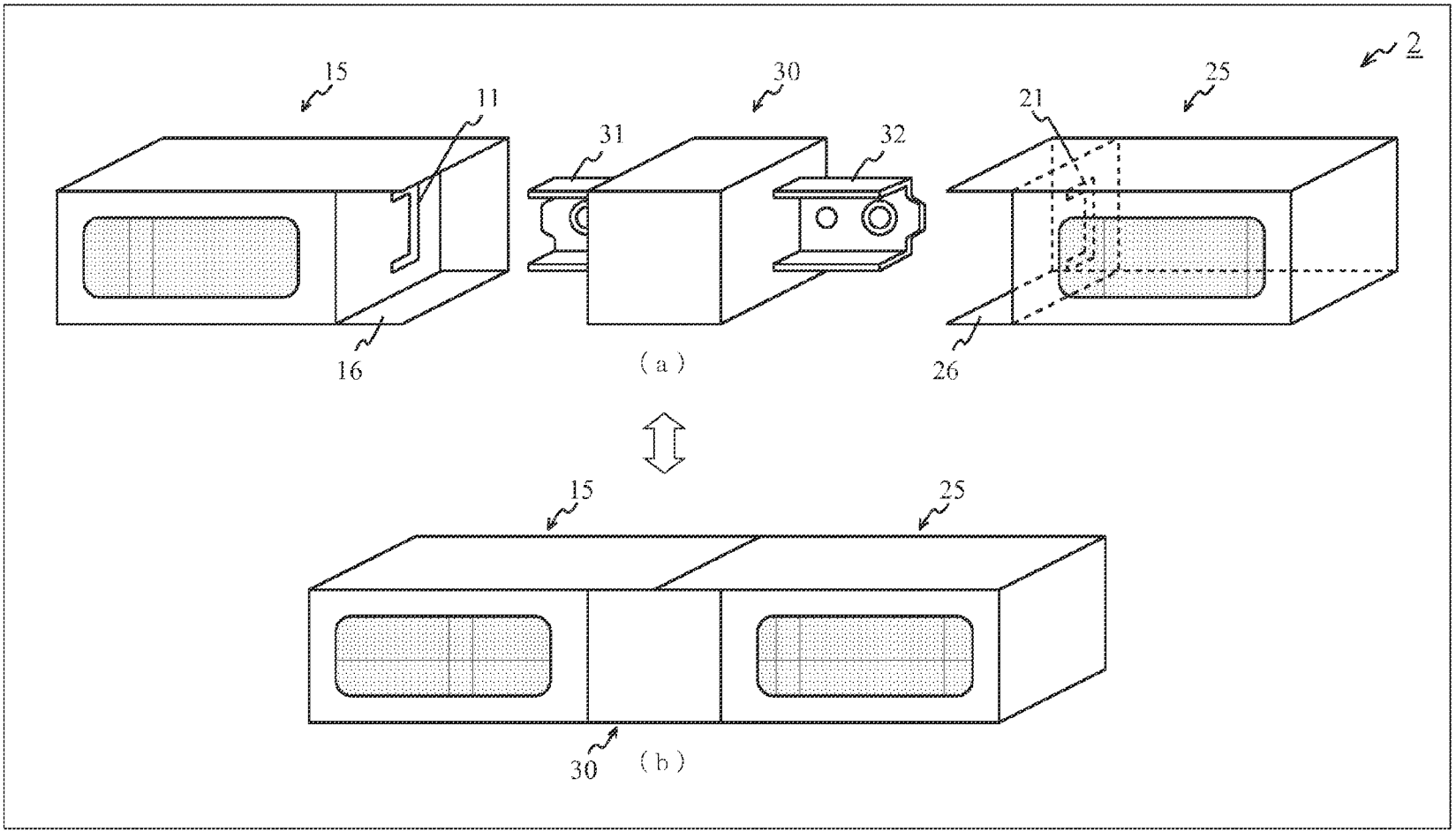
FIG. 1B shows a configuration of another bar-type speaker device 2 according to one embodiment of the present invention.

As another bar-type speaker device 2 that is equivalent in function but different in design, a configuration shown in FIG. 1B is conceivable. The speaker device 2 shown in FIG. 1B includes a first speaker unit 15 having a flange 16 on the groove part 11 side, a second speaker unit 25 having a flange 26 on the groove part 21 side, and the joining component 30. If the above components are assembled in the same manner as in the case of the speaker device 1, the speaker device 2 is shaped such that the joining component 30 is enveloped by the first and second speaker units 15 and 25 ((b) of FIG. 1B).

Hereinafter, with reference to the configuration of the speaker device 1 shown FIG. 1A, the present invention will be described.

First, detailed structures of the first speaker unit 10, the second speaker unit 20, and the joining component 30 will be described. As described above, the first speaker unit 10 and the second speaker unit 20 has an identical structure. Thus, as a representative of the speaker units, the first speaker unit 10 will be described.

Figure 2:
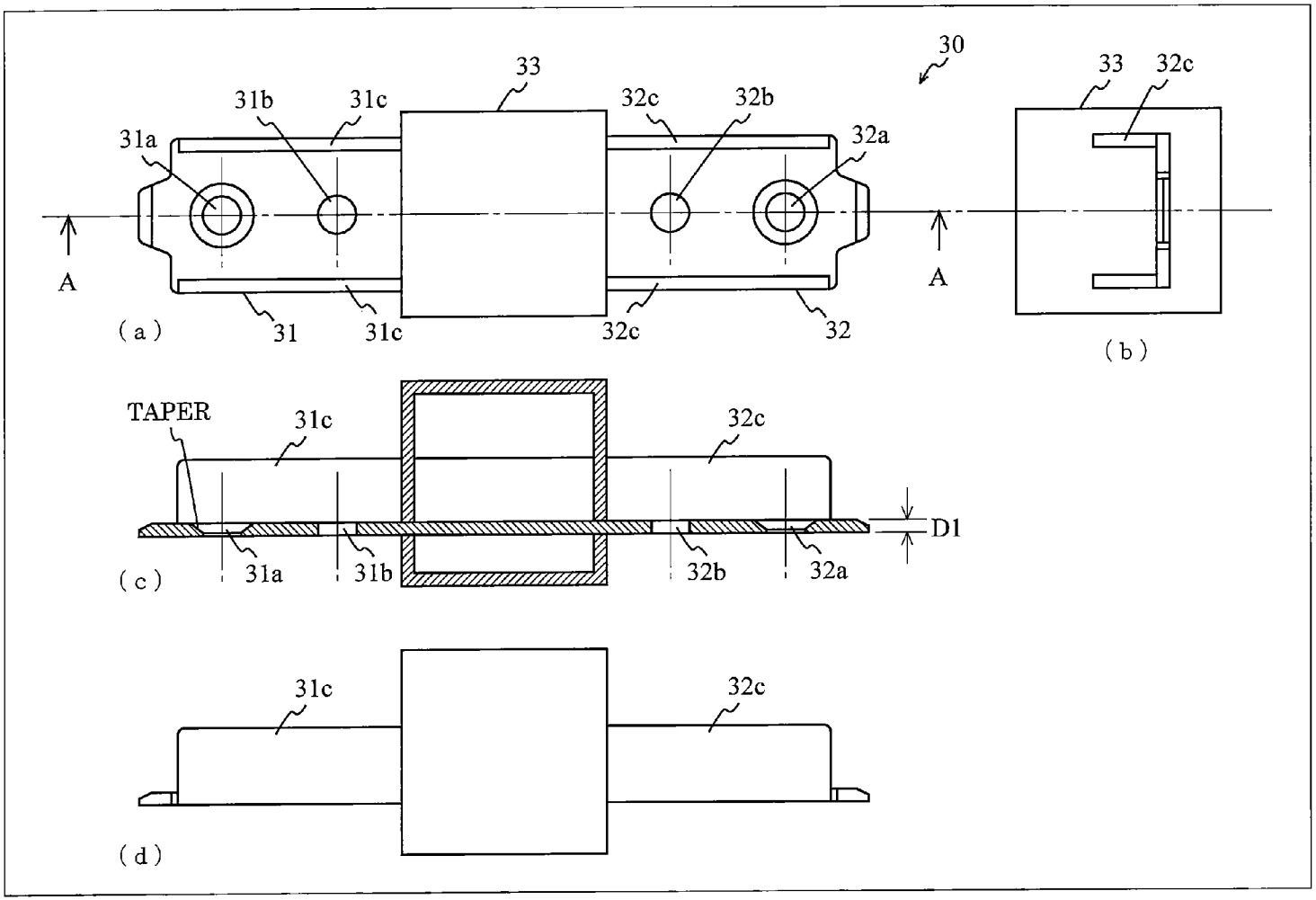
FIG. 2 illustrates a detailed structure of a joining component 30.

FIG. 2 illustrates a detailed structure of the joining component 30. FIG. 2 shows a front view (a), a right side view (b), an A-A cross-sectional view (c) in the front view, and a plan view (d) of the joining component 30.

The joining component 30 includes the first protrusion 31, the second protrusion 32, and a case 33. The first protrusion 31 protrudes from a first side surface of the case 33, and the second protrusion 32 protrudes from a second side surface facing the first side surface. The first protrusion 31 has a structure in which a main screw hole 31*a* and a sub screw hole 31*b*, which allow fixation of the first protrusion 31 with screws to the speaker unit when the first protrusion 31 is fitted into the speaker unit, are formed in a flat plate having a predetermined shape with a thickness of a distance D1. The main screw hole 31*a* is provided with a taper having a predetermined gradient. Further, the first protrusion 31 is provided with a rib 31*c* for improving the bending strength. In the present invention, as long as the main screw hole 31*a* with the taper is provided, effects characteristic to the present invention can be exhibited, and the sub screw hole 31*b* and the rib 31*c* provided for the purpose of reinforcement can be omitted. Further, similarly to the first protrusion 31, the second protrusion 32 is provided with a main screw hole 32*a*, a sub screw hole 32*b*, and a rib 32*c*.

It should be noted that the shapes, the materials, and the protrusion directions of the first protrusion 31, the second protrusion 32, and the case 33 described with reference to FIG. 2 are merely an example and can be freely designed in accordance with the purpose and the specification of the speaker device 1. Further, the first protrusion 31, the second protrusion 32, and the case 33 may be formed as separate parts, or may be formed integrally. Typically, the first protrusion 31 and the second protrusion 32 are integrally formed through sheet metal working.

Figure 3:
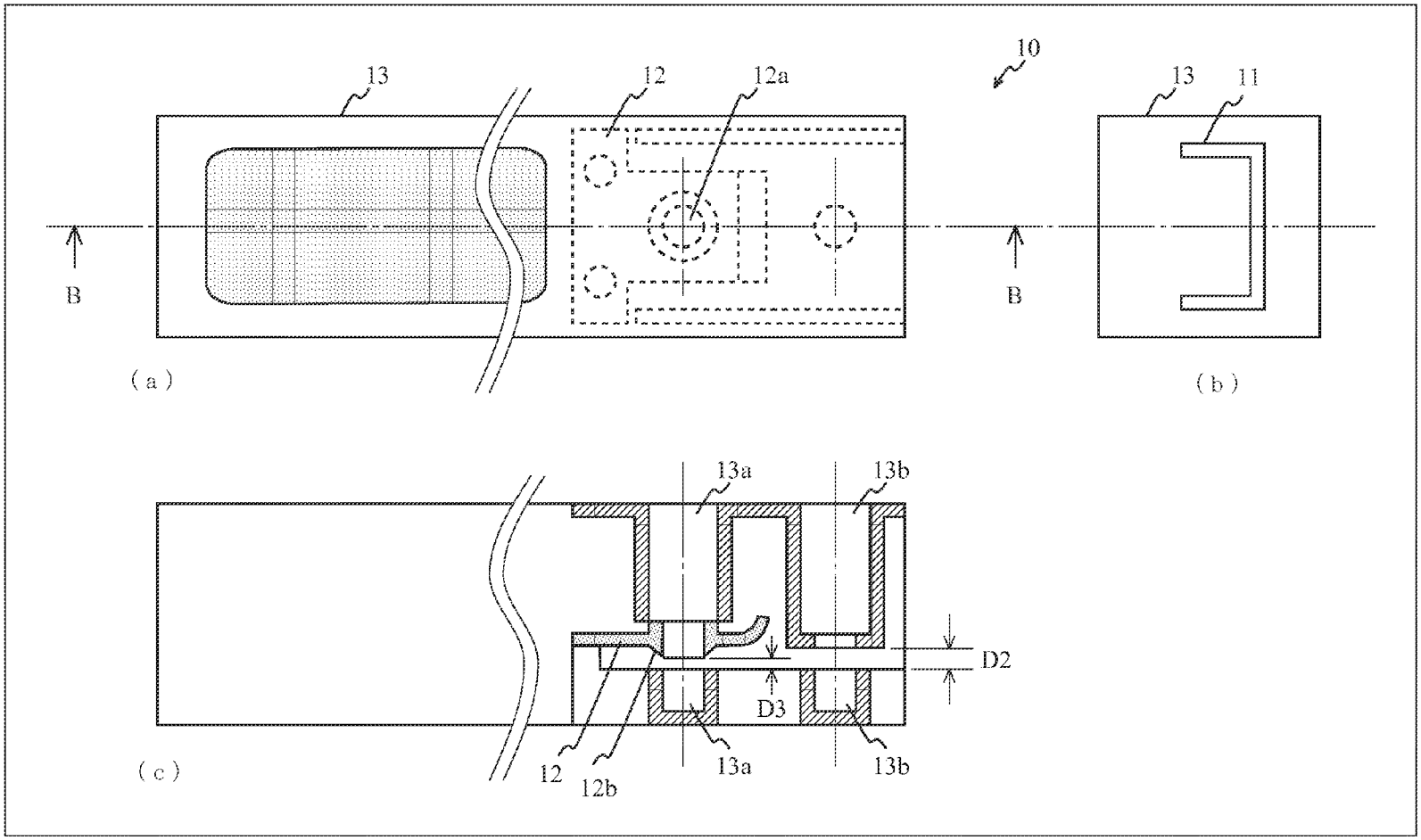
FIG. 3 illustrates a detailed structure of a first speaker unit 10.

FIG. 3 illustrates a detailed structure of the first speaker unit 10. FIG. 3 shows a front view (a), a right side view (b), and a B-B cross-sectional view (c) in the front view of the first speaker unit 10.

Figure 4:
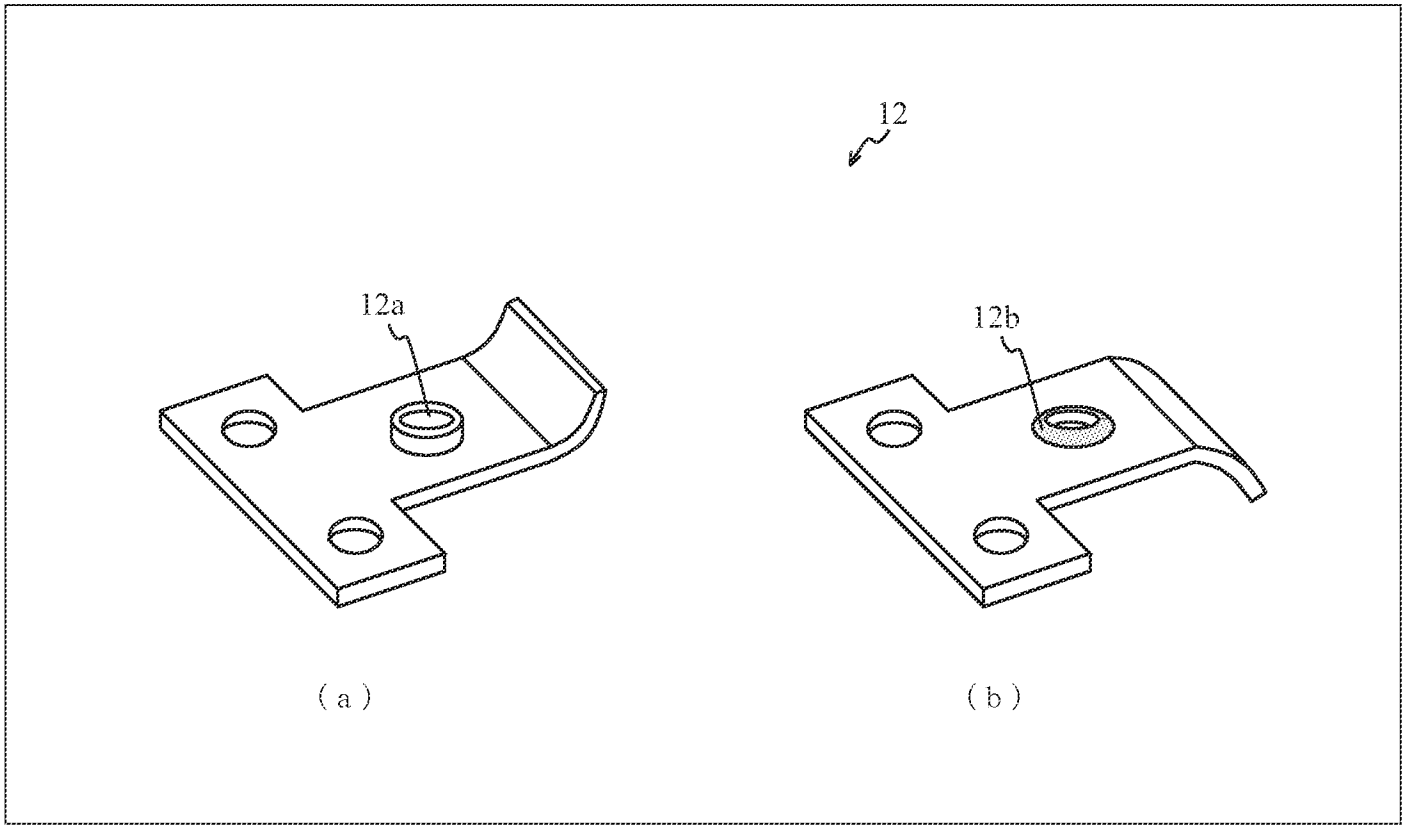
FIG. 4 is a perspective view of a spring part 12.

FIG. 4 shows a perspective view (a) seen from the top surface and a perspective view (b) seen from the rear surface of a spring part 12 shown in FIG. 3.

The first speaker unit 10 includes the groove part 11, the spring part 12, and a case 13. The groove part 11 includes an opening on a side surface of the case 13 and is a fitting guide groove having a cross section shape and a depth that allow insertion of the first protrusion 31 (or the second protrusion 32. This applies to the description below although not explicitly indicated.) thereinto. The spring part 12 is a member formed from elastic resin or the like, and is provided at a position where the first protrusion 31 inserted in the groove part 11 is pressed to be fixed. The spring part 12 is provided with a screw hole 12*a* having a rib 12*b* (shaded portion in FIG. 4) formed on the rear surface side of the spring part 12 which is brought into contact with the first protrusion 31 inserted in the groove part 11. The rib 12*b* has a taper for being hooked in the main screw hole 31*a* of the first protrusion 31. Thus, a distance D2 and a distance D3 shown in the B-B cross-sectional view (c) of FIG. 3 are designed so as to satisfy, relative to the distance D1 shown in the A-A cross-sectional view (c) of FIG. 2, the relationship of D2≥D1>D3. It should be noted that the gradient of the taper of the rib 12*b* of the spring part 12 is the same as the gradient of the taper of the main screw hole 31*a* of the first protrusion 31.

The case 13 includes screw holes 13*a* and 13*b*. By inserting a screw through the screw hole 13*a*, the screw hole 12*a*, and the main screw hole 31*a* and by tightening the screw, the spring part 12, the first protrusion 31, and the case 13 are fixed together. Further, by inserting a screw through the screw hole 13*b* and the sub screw hole 31*b* and by tightening the screw, the first protrusion 31 and the case 13 are fixed together.

It should be noted that the shape, the material, and the like of the groove part 11, the spring part 12, and the case 13 described with reference to FIG. 3 are merely an example, and can be freely designed in accordance with the purpose and the specification of the speaker device 1. Further, the spring part 12 and the case 13 may be formed as separate parts, or may be formed integrally. Although the first speaker unit 10 has a configuration for exhibiting a function as a speaker which is the essential function thereof, the configuration is not the main point of the present invention, and thus is not shown or described herein.

Next, further with reference to FIG. 5, FIG. 6A to FIG. 6D, description will be given of a mechanism that can generate, thanks to the characteristic structure of the speaker device 1 of the present invention can generate, so-called click feeling which gives a feeling that, when the first protrusion 31 is fitted into the groove part 11, the first protrusion 31 has been successfully inserted to a prescribed position, and that can bring the first speaker unit 10 and the joining component 30 into firm and close contact with each other through the screwing.

Figure 5:
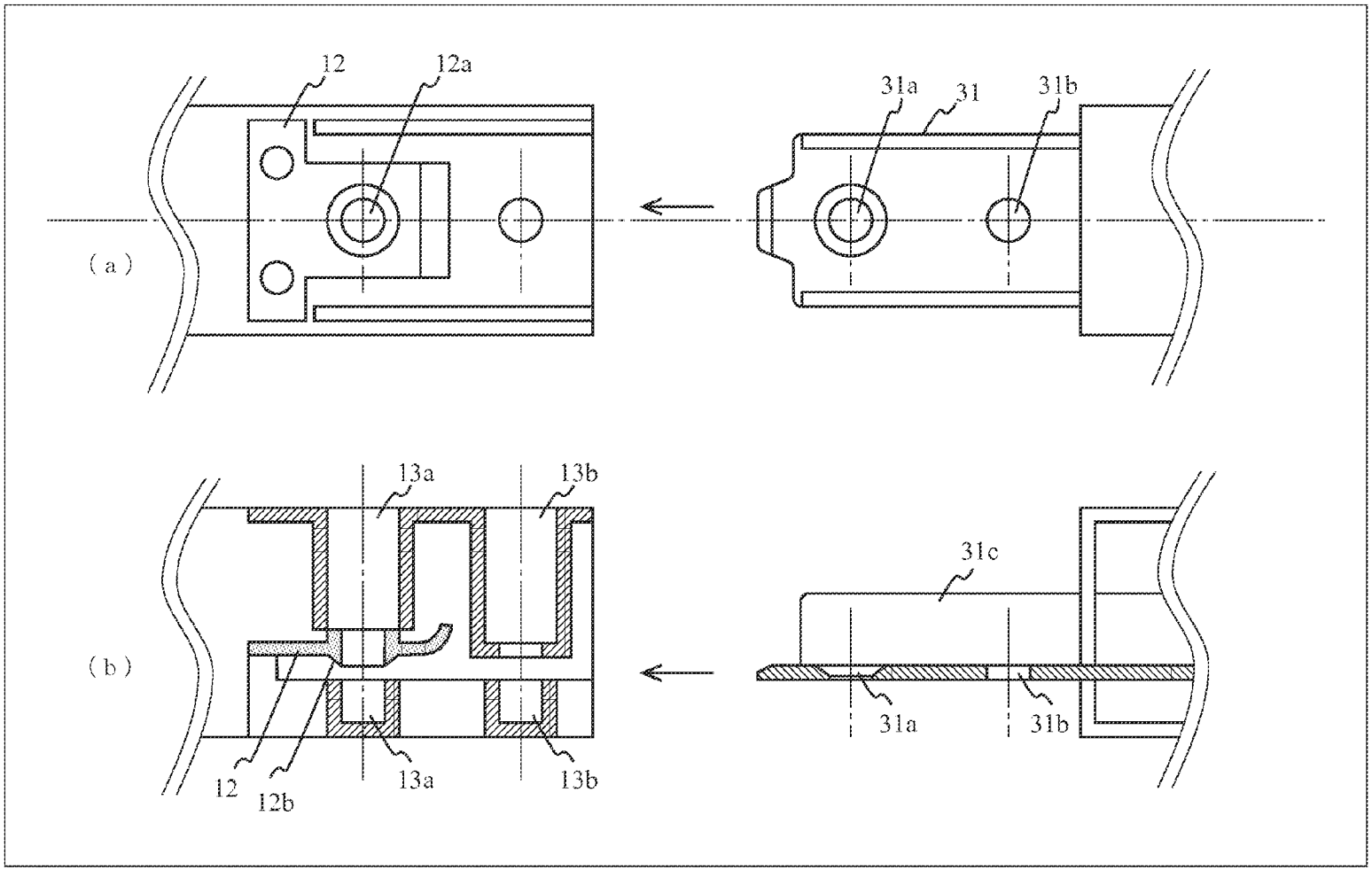
FIG. 5 shows a positional relationship between the first speaker unit 10 and the joining component 30 before fitting.

FIG. 5 shows a front view (a) and a cross-sectional view (b) illustrating the positional relationship between the first speaker unit 10 and the joining component 30 before the fitting.

FIG. 6A to FIG. 6D show step by step how the first protrusion 31 of the joining component 30 is inserted into the groove part 11 of the first speaker unit 10, from the positional relationship shown in the cross-sectional view (b) of FIG. 5.

In FIG. 5 and FIG. 6A to FIG. 6D, some of the components are omitted or drawn in a perspective manner, to facilitate understanding of the fitting operation between the first speaker unit 10 and the joining component 30.

When the first protrusion 31 of the joining component 30 is inserted into the groove part 11 of the first speaker unit 10 from the position shown in FIG. 5, the tip of the first protrusion 31 hits the rib 12*b* of the spring part 12 (FIG. 6A), first.

Figure 6A:
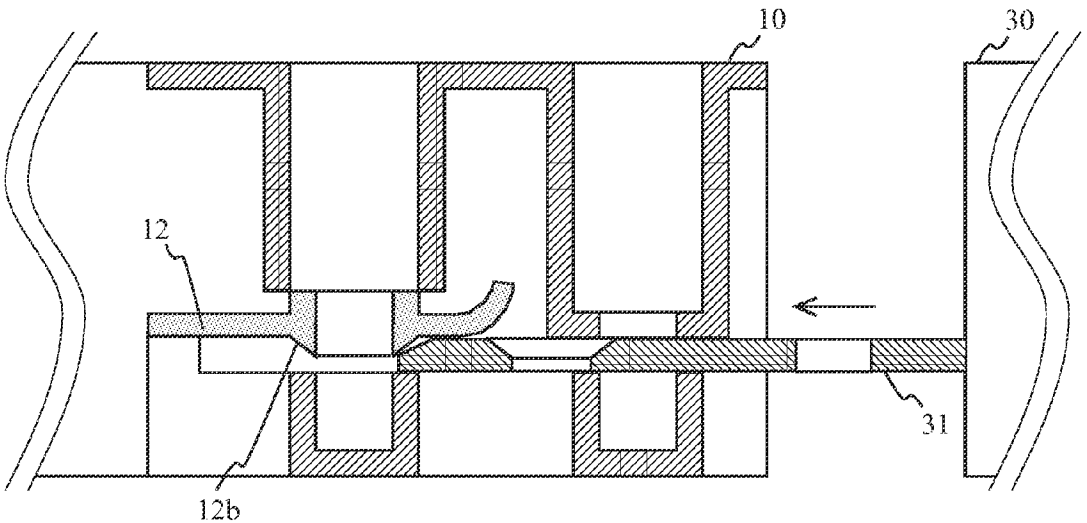
FIG. 6A shows a step of how a first protrusion 31 is inserted into a groove part 11.
Figure 6B:
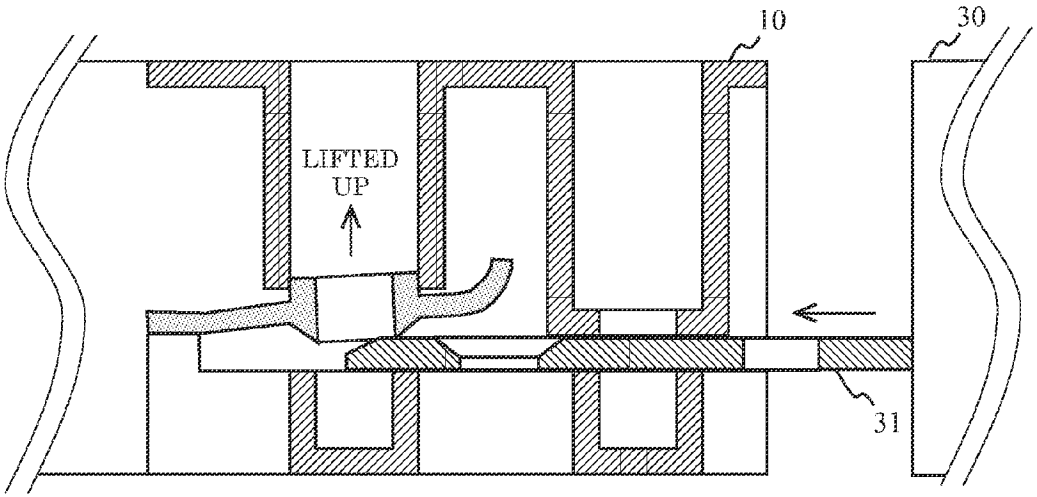
FIG. 6B shows a step of how the first protrusion 31 is inserted into the groove part 11.

When the first protrusion 31 is further inserted from the state where the tip of the first protrusion 31 abuts against the rib 12*b* of the spring part 12, since the relationship of the distance D1>the distance D3 is satisfied as described above, the spring part 12 is warped and lifted up due to the elasticity of the spring part 12, and the rib 12*b* is raised to be located on the first protrusion 31 (FIG. 6B).

Figure 6C:
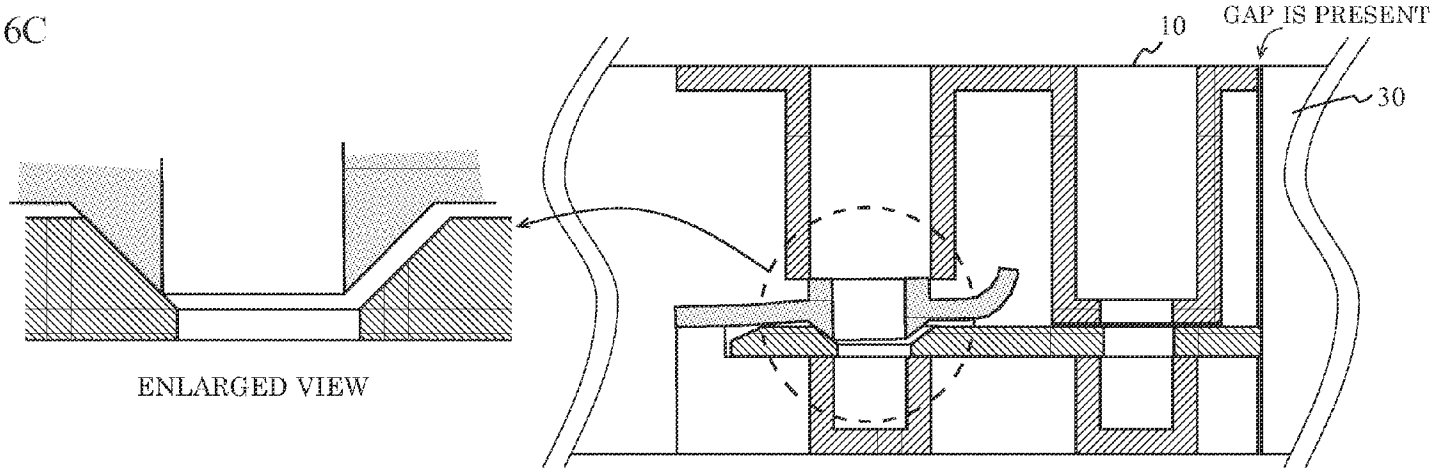
FIG. 6C shows a step of how the first protrusion 31 is inserted into the groove part 11.

Then, when the first protrusion 31 is further inserted from the state where the rib 12*b* of the spring part 12 is located on the first protrusion 31, and the first side surface of the joining component 30 is caused to abut against the side surface of the first speaker unit 10, the rib 12*b* enters the main screw hole 31*a* of the first protrusion 31 due to the resilience of the spring part 12, and the first protrusion 31 is hooked on the spring part 12 (FIG. 6C). At the time when the rib 12*b* which has been located on the first protrusion 31 enters the main screw hole 31*a*, the click feeling described above is generated.

Upon generating this click feeling, temporary fixation of the joining component 30 and the first speaker unit 10 is competed. However, as shown in the enlarged view of FIG. 6C, this temporary fixation state is not a state where the taper of the rib 12*b* of the spring part 12 and the taper of the main screw hole 31*a* of the first protrusion 31 are in close contact with each other. Thus, a gap may be generated between the first side surface of the joining component 30 and the side surface of the first speaker unit 10.

Figure 6D:
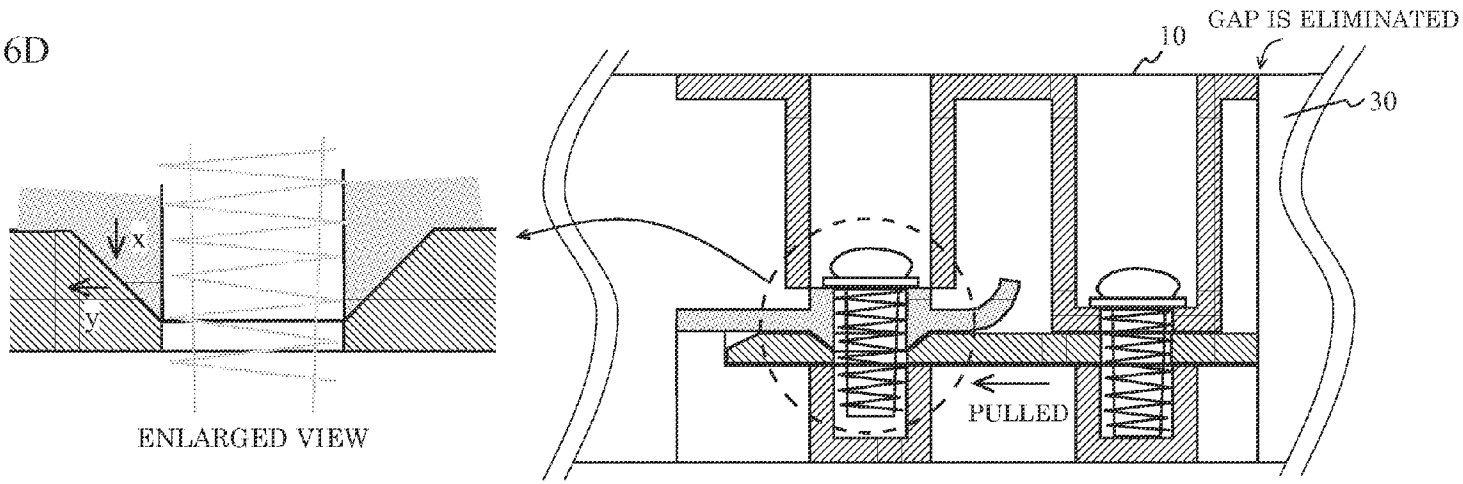
FIG. 6D shows a step of how the first protrusion 31 is inserted into the groove part 11.

Thus, next, a screw is inserted through the screw hole 13*a* of the case 13, the screw hole 12*a* of the spring part 12, and the main screw hole 31*a* of the first protrusion 31, to tighten the spring part 12 and the first protrusion 31 (FIG. 6D). Through this tightening of the screw, the taper of the rib 12*b* of the spring part 12 is brought into contact with the taper of the main screw hole 31*a* of the first protrusion 31 with a pressure x applied thereto (enlarged view of FIG. 6D). Thus, a force y which pushes the first protrusion 31 into the groove part 11 (force that pulls the first protrusion 31) is generated. As a result, as shown in FIG. 6D, the gap (FIG. 6C) that was present between the first side surface of the joining component 30 and the side surface of the first speaker unit 10 can be reduced, and thus, the first speaker unit 10 and the joining component 30 can be brought into firm and close contact with each other (close contact appearance).

In order to generate the temporary fixation state shown in FIG. 6C, it is preferable that the center of the screw hole 12*a* of the spring part 12 and the center of the main screw hole 31*a* of the first protrusion 31 when the first speaker unit 10 and the joining component 30 are fitted together are intentionally shifted from each other. This shifted structure can be realized, for example, by providing a projecting-shaped portion (such as a rib or a warp) of about 0.1 mm formed from plastic resin, on either one of the first side surface (and the second side surface) of the joining component 30 and the side surface of the first speaker unit 10 (and a side surface of the second speaker unit 20). In this manner, by performing the tightening of the spring part 12 and the first protrusion 31 shown in FIG. 6D from the temporary fixation state shown in FIG. 6C generated with a plastic projecting-shaped portion provided, it is possible to reduce the gap between the first side surface of the joining component 30 and the side surface of the first speaker unit 10 through deformation of the projecting-shaped portion.

As described above, in the speaker device according to one embodiment of the present invention, the main screw hole provided in the protrusion of the joining component is provided with a taper having a predetermined gradient, and the screw hole of the spring part provided in the speaker unit is provided with a rib having a taper having the same gradient as that of the taper of the main screw hole. Accordingly, when the joining component is fitted into the speaker unit, the click feeling can be generated, and further, when the screwing is performed, the gap between the joining component and the speaker unit can be reduced.

Accordingly, in the speaker device according to one embodiment of the present invention, when the user freely customizes the configuration of the speaker device, the user can have an actual feeling that the state of the joined components is normal (click feeling). Thus, troublesome joining work is not required, and the level of integrity (close contact appearance) of the speaker device can be prevented from varying. Therefore, it is possible to exhibit a special effect that can obtain a satisfactory level of integrity through a single joining operation.

Further, in the speaker device according to one embodiment of the present invention, the relative position between the speaker unit and the joining component is designed in advance such that the center of the taper of the screw hole of the spring part provided in the speaker unit and the center of the taper of the screw hole of the joining component are slightly shifted (about 0.1 mm) from each other. When a screw is tighten in this shift design, in accordance with advancement of the tightening, the taper of the screw hole of the joining component gradually moves along the slope of the taper of the screw hole of the spring part, and the centers of the tapers of both screw holes which are originally shifted from each other will be aligned at the time when the screw is completely tightened. Thus, repulsion can be continuously generated between the spring part provided in the speaker unit and the joining component, that is, a pulling force can be continuously generated between the speaker unit and the joining component. Accordingly, improvement of the overall strength of the speaker device, aesthetic unity of the speaker device, and evenness of the gap can be realized.

It should be noted that the taper of the rib 12*b* of the spring part 12 described in the above embodiment may be realized in the following structures.

Figure 7A:
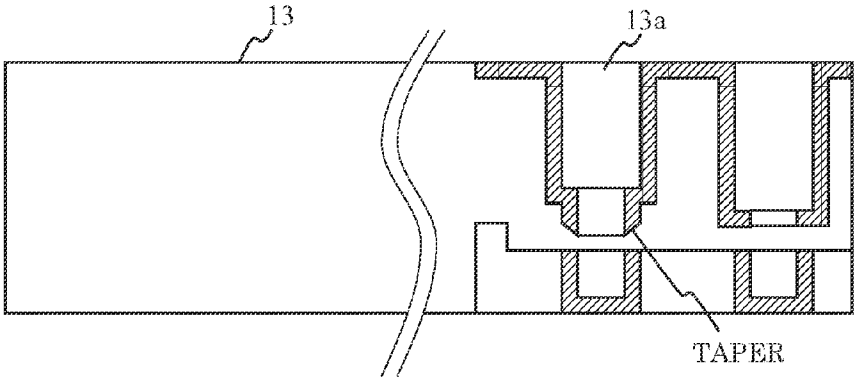
FIG. 7A is another structure example for realizing a taper of a rib 12*b* of the spring part 12.

In an example structure, as shown in FIG. 7A, instead of preparing the spring part 12 as a separate part from the case 13, a taper is provided at a tip portion of a boss in which the screw hole 13*a* is formed. However, in this structure, since the portion of the taper is not elastic (does not move), it is conceivable that the click feeling is not generated so evidently.

Figure 7B:
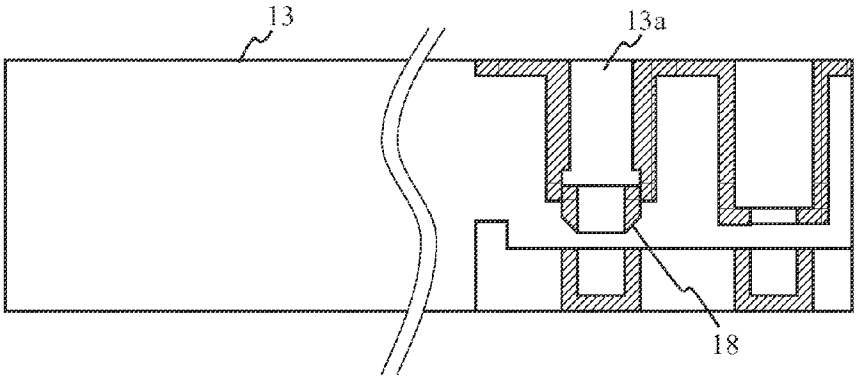
FIG. 7B is another structure example for realizing a taper of the rib 12*b* of the spring part 12.

In another structure, as shown in FIG. 7B, an elastic C-shaped spring component 18 provided with a taper at the tip thereof is prepared, and the spring component 18 is fitted into a tip portion of a boss in which the screw hole 13*a* is formed. Also in this structure, since the C-shaped spring component

18 is not elastic (does not move) in the up-down direction, it is conceivable that the click feeling is not generated so evidently.

Although in the above embodiment, the first speaker unit 10 and the second speaker unit 20 has an identical structure, they may have different structures from each other, such that one is for a right channel and the other is for a left channel of a two-channel stereo. However, in this case, a fool proof design is necessary in which the first protrusion 31 and the second protrusion 32 of the joining component 30 are formed in different shapes, and the like.

Further, in the above embodiment, description has been given of the bar-type speaker device whose left and right channel speaker units are connected into a single bar shape. However, the bar type is merely an example of aspects realized by a speaker system whose shape can be freely changed. The bar type is an aspect for installing the speaker device above or below a display such as a thin-screen television. However, in order to realize aspects in which the speaker device is installed to the left and/or the right of the display, a joining component 40 as shown in FIG. 8 may be provided in the speaker system, for example.

Figure 8:
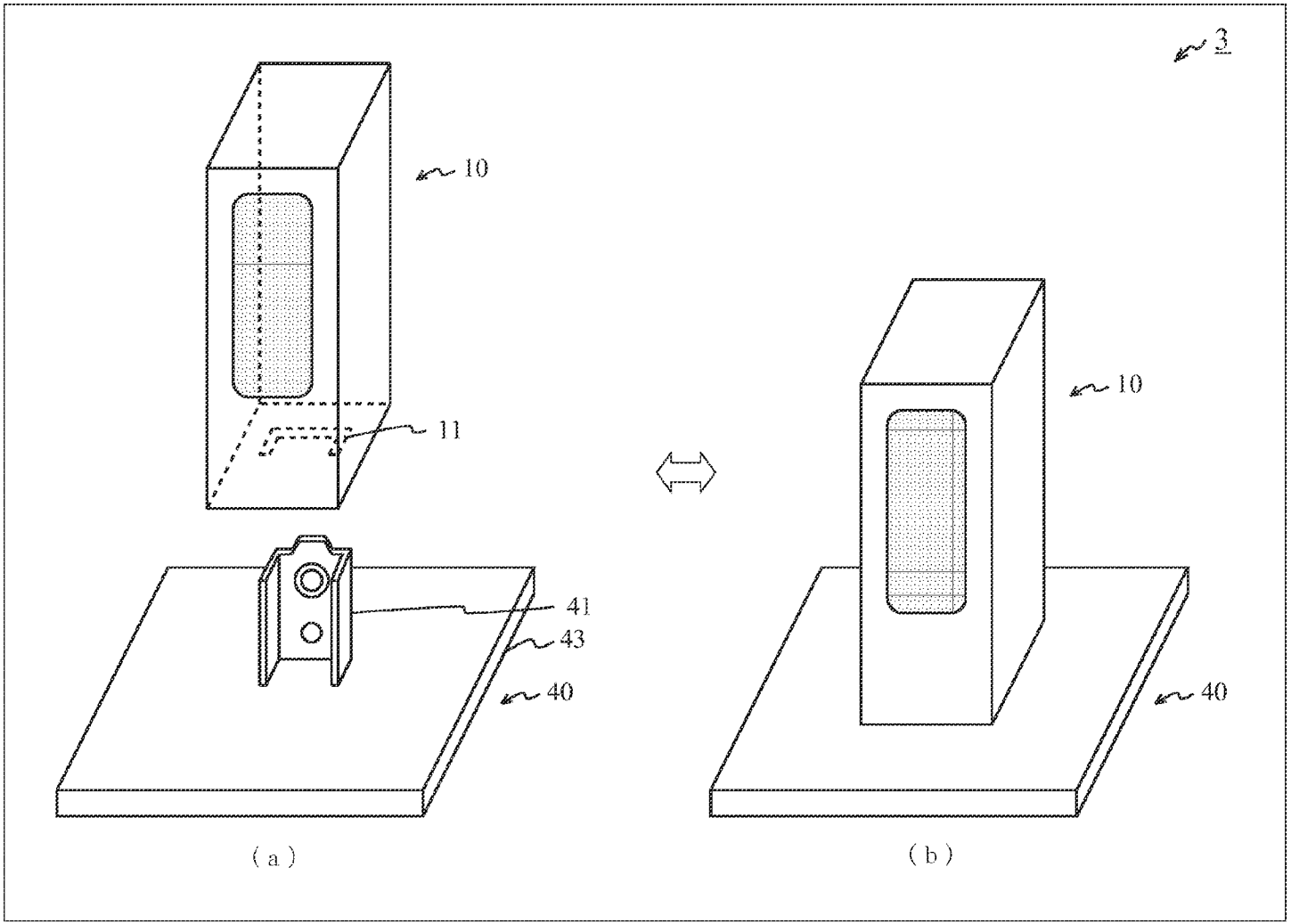
FIG. 8 shows a configuration of a standing-type speaker device 3 according to one embodiment of the present invention.

The joining component 40 illustrated in FIG. 8 includes a protrusion 41 having a shape identical to that of the protrusion 31 or 32 on the upper surface of a base 43 ((a) of FIG. 8). By fitting the groove part 11 of the first speaker unit 10 (or the groove part 21 of the second speaker unit 20) onto the protrusion 41, a standing-type speaker device 3 shown in (b) of FIG. 8 can be formed.

This standing-type speaker device 3 is not necessarily used in a pair, i.e., left and right. For example, when monaural sound is outputted, one of the speaker device 3 may be used.

INDUSTRIAL APPLICABILITY

The structure of the present invention can be used in a speaker device and the like that includes two speaker units capable of being joined together or separated from each other. In particular, the structure of the present invention is useful when it is desired to generate the click feeling at the time of joining work, or to improve the close contact appearance between components, and the like.

DESCRIPTION OF THE REFERENCE CHARACTERS

1, 2, 3 speaker device
10, 15, 20, 25 speaker unit
11, 21 groove part
12 spring part
12*a*, 13*a*, 13*b*, 31*a*, 32*a*, 31*b*, 32*b* screw hole
12*b*, 31*c*, 32*c* rib
13, 33 case
16, 26 flange
18 spring component
30, 40 joining component
31, 32, 41 protrusion
43 base

The invention claimed is:

1. A bar-type speaker device including two speaker units capable of being joined together and separated from each other, the bar-type speaker device comprising:

a first speaker unit provided with a groove part;

a second speaker unit provided with a groove part; and a joining component including two protrusions respectively provided with screw holes, and configured to join the first speaker unit and the second speaker unit into a bar shape by respectively fitting the two protrusions into the groove parts, wherein each of the first and second speaker units includes a spring part configured to press and fix the fitted protrusion, the spring part is provided with a screw hole having a rib configured to be hooked in the screw hole of the protrusion when the protrusion is fitted into the groove part, each of the screw hole of the protrusion and the rib of the screw hole of the spring part is provided with a taper having an identical gradient, during temporary fixation, a center of the taper of the screw hole of the protrusion and a center of the taper of the rib of the screw hole of the spring part are shifted from each other, and by aligning the centers of the two tapers through screw fixation, the taper of the rib of the screw hole of the spring part is brought into contact with the taper of the screw hole of the protrusion with a pressure applied thereon, to bring the first and second speaker units and the joining component into close contact with each other.

2. The bar-type speaker device according to claim 1, further comprising:

a second joining component including, on a base, a protrusion having a shape identical to that of the two protrusions, wherein the bar-type speaker device is capable of being changed into a standing-type speaker device, by fitting the groove part of the first or second speaker unit onto the protrusion of the second joining component.

* * * * *